US011151880B1

(12) United States Patent
Shou et al.

(10) Patent No.: US 11,151,880 B1
(45) Date of Patent: Oct. 19, 2021

(54) SYSTEMS AND METHODS FOR PROVIDING GUIDANCE TO VEHICLE DRIVERS REGARDING PREDICTED LANE-CHANGE BEHAVIOR OF OTHER VEHICLE DRIVERS

(71) Applicant: Toyota Motor Engineering & Manufacturing North America, Inc., Plano, TX (US)

(72) Inventors: Zhenyu Shou, Milpitas, CA (US); Kyungtae Han, Palo Alto, CA (US); Ziran Wang, San Jose, CA (US); Yongkang Liu, Plano, TX (US); Prashant Tiwari, Santa Clara, CA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 16/999,332

(22) Filed: Aug. 21, 2020

(51) Int. Cl.
*G08G 1/16* (2006.01)
*G08G 1/01* (2006.01)

(52) U.S. Cl.
CPC ..... *G08G 1/167* (2013.01); *G08G 1/0108* (2013.01); *G08G 1/0129* (2013.01)

(58) Field of Classification Search
CPC .... B60W 40/08; B60W 30/095; B60W 30/00; G05D 1/021; G01C 21/3617; G06Q 30/0266; G08G 1/096838; G06N 20/00
See application file for complete search history.

(56) References Cited

U.S. PATENT DOCUMENTS 10,430,695 B2 10/2019 Sathyanarayana et al.
2010/0106603 A1* 4/2010 Dey ..... G01C 21/3617 705/14.63

(Continued)

OTHER PUBLICATIONS

Kourkouss et al., "Anticipating Driver Actions via Deep Neural Networks and New Driver Personalization Technique Through Transfer Learning," Proceedings of the 4th International Conference on Vehicle Technology and Intelligent Transport Systems (VEHITS 2018), pp. 269-276, found at https://www.scitepress.org/Link.aspx?doi=10.5220%2f0006669002690276.

(Continued)

*Primary Examiner* — Mirza F Alam
(74) *Attorney, Agent, or Firm* — Christopher G. Darrow; Darrow Mustafa PC

(57) ABSTRACT

Systems and methods described herein relate to providing guidance to vehicle drivers regarding predicted lane-change behavior of other drivers. One embodiment transforms historical vehicle trajectory data into a corresponding alternative representation; applies a clustering algorithm to group a plurality of drivers into groups of similar drivers; applies Bayesian inference to train a Bayesian neural network (BNN) for the drivers in each group; adapts the BNN for each group to generate a personalized BNN for each driver in that group; identifies a particular driver on a roadway; receives information regarding the particular driver's vehicle and one or more other nearby vehicles; estimates a probability that the particular driver will change lanes using the personalized BNN for that driver; and communicates (Continued)

guidance regarding predicted lane-change behavior of the particular driver to at least one nearby vehicle based, at least in part, on the estimated probability that the particular driver will change lanes.

20 Claims, 6 Drawing Sheets

(56) References Cited

U.S. PATENT DOCUMENTS

| | | | | |
|---|---|---|---|---|
| 2015/0344030 | A1* | 12/2015 | Damerow | B60W 30/0956 701/1 |
| 2017/0190334 | A1* | 7/2017 | Zelman | G08G 1/096783 |
| 2018/0093671 | A1 | 4/2018 | Allan et al. | |
| 2018/0365533 | A1* | 12/2018 | Sathyanarayana | G06N 3/04 |
| 2020/0211394 | A1* | 7/2020 | King | G05D 1/0289 |

OTHER PUBLICATIONS

Wang et al., "Driver Behavior Modeling Using Game Engine and Real Vehicle: A Learning-Based Approach," IEEE Transactions on Intelligent Vehicles, Apr. 2020, found at https://www.researchgate.net/profile/Ziran_Wang3/publication/340511322_Driver_Behavior_Modeling_using_Game_Engine_and_Real_Vehicle_A_Learning-Based_Approach/links/5e9c9920299bf13079aa2992/Driver-Behavior-Modeling-using-Game-Engine-and-Real-Vehicle-A-Learning-Based-Approach.pdf.

Kasper et al., "Object-Oriented Bayesian Networks for Detection of Lane Change Maneuvers," Intelligent Transportation Systems Magazine, vol. 4, No. 1, Jan. 2012, found at https://www.researchgate.net/profile/Galia_Weid/publication/249012939_Object-Oriented_Bayesian_Networks_for_Detection_of_Lane_Change_Maneuvers/links/00b7d530de374797d3000000.pdf.

Krüger et al., "Probabilistic Lane Change Prediction Using Gaussian Process Neural Networks," 2019 IEEE Intelligent Transportation Systems Conference (ITSC), Auckland, NZ, Oct. 27-30, 2019, abstract linked at https://ieeexplore.ieee.org/abstract/document/8917049.

Schlechtriemen et al., "When Will It Change Lane? A Probabilistic Regression Algorithm for Rarely Occurring Events," 2015 IEEE Intelligent Vehicles Symposium (IV), Jun. 28-Jul. 1, 2015, COEX, Seoul, Korea, abstract linked at https://ieeexplore.ieee.org/abstract/document/7225907.

Li et al., "Development and Evaluation of Two Learning-Based Personalized Driver Models for Pure Pursuit Path-Tracking Behaviors," 2018 IEEE Intelligent Vehicles Symposium (IV), Changshu, Suzhou, China, Jun. 26-30, 2018, abstract linked at https://ieeexplore.ieee.org/abstract/document/8500618.

Liebner et al., "Generic Driver Intent Inference Based on Parametric Models," Proceedings of the IEEE Int. Conf. Intelligent Transportation Systems, Oct. 2013, pp. 268-275, found at http://citeseerx.ist.psu.edu/viewdoc/download?doi=10.1.1.640.5005&rep=rep1&type=pdf.

McCall et al., "Human Behavior Based Predictive Brake Assistance," Intelligent Vehicles Symposium 2006, Jun. 13-15, 2006, Tokyo, Japan, found at http://citeseerx.ist.psu.edu/viewdoc/download?doi=10.1.1.468.3926&rep=rep1&type=pdf.

Wang et al., "Development and Evaluation of Two Learning-Based Personalized Driver Models for Car-Following Behaviors," arXiv:703.03534v1 [cs.SY], Mar. 10, 2017, found at https://arxiv.org/pdf/1703.03534.pdf.

Wang et al., "Learning and Inferring a Driver's Braking Action in Car-Following Scenarios," arXiv:1801.03905v1 [cs. LG], Jan. 11, 2018, found at https://arxiv.org/pdf/1801.03905.pdf.

* cited by examiner

SYSTEMS AND METHODS FOR PROVIDING GUIDANCE TO VEHICLE DRIVERS REGARDING PREDICTED LANE-CHANGE BEHAVIOR OF OTHER VEHICLE DRIVERS

TECHNICAL FIELD

The subject matter described herein relates in general to vehicle driver-assistance systems and, more specifically, to systems and methods for providing guidance to vehicle drivers regarding predicted lane-change behavior of other vehicle drivers.

BACKGROUND

Vehicle driver-assistance systems can aid drivers in making decisions and avoiding a variety of hazards. Some driver-assistance systems are standalone systems deployed in individual vehicles. Other driver-assistance systems interact with and receive information from cloud servers, edge servers, roadside units, or infrastructure systems. Increasingly, machine learning techniques are being used in driver-assistance systems. Machine learning can enhance the performance of a variety of driver-assistance applications.

SUMMARY

Embodiments of a system for providing guidance to vehicle drivers regarding predicted lane-change behavior of other vehicle drivers are presented herein. In one embodiment, the system comprises one or more processors and a memory communicably coupled to the one or more processors. The memory stores a data preparation module including instructions that when executed by the one or more processors cause the one or more processors to transform historical vehicle trajectory data for each of a plurality of drivers into a corresponding alternative representation. The memory also stores a clustering module including instructions that when executed by the one or more processors cause the one or more processors to apply a clustering algorithm to the corresponding alternative representations of the historical vehicle trajectory data to group the plurality of drivers into a plurality of groups, the drivers in each group in the plurality of groups having similar driving behavior. The memory also stores a Bayesian inference module including instructions that when executed by the one or more processors cause the one or more processors to apply, for each group in the plurality of groups, Bayesian inference to the corresponding alternative representations of the historical vehicle trajectory data for the drivers in that group to train a Bayesian neural network (BNN) for the drivers in that group. The memory also stores an adaptation module including instructions that when executed by the one or more processors cause the one or more processors to adapt, for each group in the plurality of groups, the BNN for the drivers in that group to generate a personalized BNN for each driver in that group. The memory also stores a lane-change guidance module including instructions that when executed by the one or more processors cause the one or more processors to identify a particular driver in the plurality of drivers while the particular driver is driving on a roadway; receive information regarding a vehicle driven by the particular driver and one or more other vehicles in a vicinity of the vehicle driven by the particular driver; estimate a probability that the particular driver will change lanes by processing the received information using the personalized BNN for the particular driver; and communicate guidance regarding predicted lane-change behavior of the particular driver to at least one of the one or more other vehicles in the vicinity of the vehicle driven by the particular driver based, at least in part, on the estimated probability that the particular driver will change lanes.

Another embodiment is a non-transitory computer-readable medium for providing guidance to vehicle drivers regarding predicted lane-change behavior of other vehicle drivers and storing instructions that when executed by one or more processors cause the one or more processors to transform historical vehicle trajectory data for each of a plurality of drivers into a corresponding alternative representation. The instructions also cause the one or more processors to apply a clustering algorithm to the corresponding alternative representations of the historical vehicle trajectory data to group the plurality of drivers into a plurality of groups, the drivers in each group in the plurality of groups having similar driving behavior. The instructions also cause the one or more processors to apply, for each group in the plurality of groups, Bayesian Inference to the corresponding alternative representations of the historical vehicle trajectory data for the drivers in that group to train a Bayesian neural network (BNN) for the drivers in that group. The instructions also cause the one or more processors to adapt, for each group in the plurality of groups, the BNN for the drivers in that group to generate a personalized BNN for each driver in that group. The instructions also cause the one or more processors to identify a particular driver in the plurality of drivers while the particular driver is driving on a roadway. The instructions also cause the one or more processors to receive information regarding a vehicle driven by the particular driver and one or more other vehicles in a vicinity of the vehicle driven by the particular driver. The instructions also cause the one or more processors to estimate a probability that the particular driver will change lanes by processing the received information using the personalized BNN for the particular driver. The instructions also cause the one or more processors to communicate guidance regarding predicted lane-change behavior of the particular driver to at least one of the one or more other vehicles in the vicinity of the vehicle driven by the particular driver based, at least in part, on the estimated probability that the particular driver will change lanes.

Another embodiment is a method of providing guidance to vehicle drivers regarding predicted lane-change behavior of other vehicle drivers, the method comprising transforming historical vehicle trajectory data for each of a plurality of drivers into a corresponding alternative representation. The method also includes applying a clustering algorithm to the corresponding alternative representations of the historical vehicle trajectory data to group the plurality of drivers into a plurality of groups, the drivers in each group in the plurality of groups having similar driving behavior. The method also includes applying, for each group in the plurality of groups, Bayesian inference to the corresponding alternative representations of the historical vehicle trajectory data for the drivers in that group to train a Bayesian neural network (BNN) for the drivers in that group. The method also includes adapting, for each group in the plurality of groups, the BNN for the drivers in that group to generate a personalized BNN for each driver in that group. The method also includes identifying a particular driver in the plurality of drivers while the particular driver is driving on a roadway. The method also includes receiving information regarding a vehicle driven by the particular driver and one or more other vehicles in a vicinity of the vehicle driven by the particular driver. The method also includes estimating a probability that the particular driver will change lanes by processing the received information using the personalized BNN for the particular driver. The method also includes communicating guidance regarding predicted lane-change behavior of the particular driver to at least one of the one or more other vehicles in the vicinity of the vehicle driven by the particular driver based, at least in part, on the estimated probability that the particular driver will change lanes.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Figure 1:
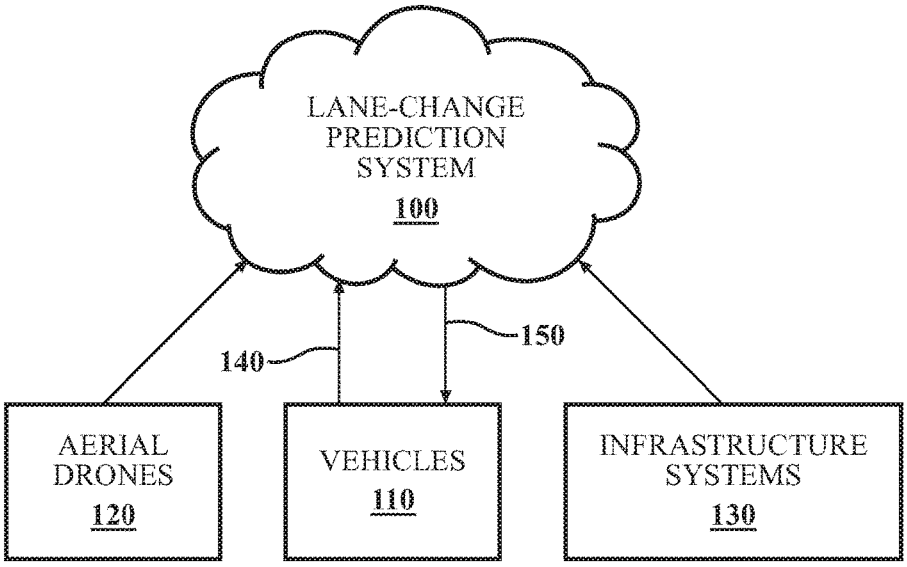
FIG. 1 is an architecture diagram illustrating an environment in which a lane-change prediction system can be deployed, in accordance with an illustrative embodiment of the invention.

Various embodiments of systems and methods for providing guidance to vehicle drivers regarding predicted lane-change behavior of other vehicle drivers are described herein. For example, in one embodiment, a personalized probabilistic lane-change prediction system (hereinafter, a "lane-change prediction system") helps drivers anticipate possible near-future cut-in (sudden lane-changing) behavior of nearby vehicles. Drivers can thus adjust their speed or even change lanes to avoid a conflict or collision with the cut-in vehicle. The input to the lane-change prediction system, in some embodiments, is information regarding one or more vehicles in the vicinity of an ego vehicle on a roadway, and the output is a lane-change probability distribution for the ego vehicle. The lane-change prediction system can use this probability distribution to predict the ego vehicle driver's lane-change behavior and can transmit guidance regarding the ego vehicle driver's predicted lane-change behavior to at least some of the nearby vehicles (e.g., vehicles following the ego vehicle in the same or adjacent lanes).

One advantage of the embodiments described herein is that predicted lane-change behavior of a particular driver is based on a personalized probabilistic model for that specific driver. To create such a personalized prediction model, the lane-change prediction system first transforms historical vehicle trajectory data for each individual driver into an alternative representation (e.g., a sequence or matrix representation). The system then applies a clustering algorithm to cluster the drivers into a plurality of groups so that the drivers within each group share similar driving behavior. The system then applies Bayesian inference to the data of all drivers in each group (cluster), and the system trains and outputs a Bayesian neural network (BNN) for each group. Finally, the system adapts the BNN model for each group to each individual driver in that group using each driver's data to generate a personalized BNN model for each driver in the group.

Once a personalized BNN model has been generated for each driver in the plurality of drivers, the lane-change prediction system can use the personalized BNN models to provide driver-assistance guidance to networked connected vehicles. As those skilled in the art are aware, a "connected vehicle" is a vehicle with vehicle-to-infrastructure (V2I) and/or vehicle-to-vehicle (V2V) communication capability. In the embodiments described herein, V2I communication capability (e.g., the ability of the vehicles to communicate with a cloud server that hosts the lane-change prediction system) is particularly relevant.

In one embodiment, the system identifies a particular driver while the particular driver is driving on a roadway. The system receives information regarding the vehicle driven by the particular driver (the "ego vehicle") and one or more other vehicles in the vicinity of the ego vehicle. In various embodiments, this information can include spatial relationships (e.g., distances) among the ego vehicle and the other nearby vehicles, vehicle position data, vehicle speed data, vehicle acceleration data, vehicle pose data, driver emotional-state data, and/or driver fatigue-level data. The system estimates the probability that the particular driver will change lanes by processing the received information using the particular driver's personalized BNN (personalized lane-change prediction model). The system then communicates guidance regarding predicted lane-change behavior of the particular driver to at least one of the other nearby vehicles (e.g., one or more vehicles following the ego vehicle). This guidance is based, at least in part, on the estimated probability that the particular driver will change lanes. In some embodiments, the provided guidance is also based, at least in part, on the estimated probability that the particular driver will remain in a current lane (i.e., not change lanes).

The guidance the lane-change prediction system provides to vehicles near the ego vehicle can include, for example, the estimated probability that the particular driver will change lanes, the estimated probability that the particular driver will remain in (keep) the current lane, and an identification of a particular lane to which the particular driver is likely to change lanes. Depending on the embodiment, this guidance can be presented to a driver via a head-up display (HUD), a different type of in-vehicle display (e.g., an in-dashboard display), an audio message, or a combination of these techniques.

Referring to FIG. 1, it is an architecture diagram illustrating an environment in which a lane-change prediction system 100 can be deployed, in accordance with an illustrative embodiment of the invention. In FIG. 1, lane-change prediction system 100 includes a personalized probabilistic lane-change prediction model (not shown in FIG. 1) for each of a plurality of drivers. In some embodiments, the personalized probabilistic lane-change model is a personalized Bayesian neural network (BNN). How the BNNs are trained and adapted for personalization is discussed further below.

In an on-line deployment, lane-change prediction system 100 receives information regarding a vehicle driven by a particular driver (the "ego vehicle") and one or more other vehicles in the vicinity of the ego vehicle (e.g., vehicles traveling in the same or an adjacent lane as the ego vehicle that are within the range of the environmental sensors with which the ego vehicle is equipped). The received information ("vehicle information") can include, without limitation, one or more of spatial relationships among the ego vehicle and the one or more other nearby vehicles, vehicle position data, vehicle speed data, vehicle acceleration data, vehicle pose data, driver emotional-state data, and driver fatigue-level data. These different kinds of vehicle information are discussed further below.

Depending on the particular embodiment, lane-change prediction system 100 can receive vehicle information from a variety of different sources. Examples of those sources are included in FIG. 1. For example, lane-change prediction system 100 can receive vehicle information from the vehicles 110 (the ego vehicle and the other vehicles in the vicinity of the ego vehicle) themselves based on the vehicles' sensor data 140. As those skilled in the art are aware, vehicle sensors can include cameras, Light Detection and Ranging (LIDAR) sensors, radar sensors, and sonar sensors. Lane-change prediction system 100, in some embodiments, can receive vehicle information from any of a variety of infrastructure systems 130 such as roadside units (RSUs), traffic signal systems, or other infrastructure systems or devices. Also, in some embodiments, lane-change prediction system 100 can receive vehicle information from one or more aerial drones 120.

Based on the input vehicle information discussed above, lane-change prediction system 100 uses the personalized BNN corresponding to the driver of the ego vehicle to estimate the likelihood that the driver of the ego vehicle will change lanes or keep the current lane. This prediction or other information (e.g., a suggested or recommended maneuver) based on the prediction can be transmitted to one or more of the vehicles in the vicinity of the ego vehicle (e.g., vehicles nearby that are following the ego vehicle) as guidance 150. Everything discussed above in connection with FIG. 1 can be performed in parallel for each of the other vehicles in the vicinity of the ego vehicle, each of those vehicle being the "ego vehicle" for purposes of predicting the lane-change behavior of the respective drivers. In this way, all of the vehicles that are properly equipped can receive, from lane-change prediction system 100, lane-change-prediction guidance 150 for nearby vehicles. As mentioned above, this guidance 150 can help the drivers anticipate a likely and sudden lane change (e.g., "cut-in" behavior) by another nearby driver. In some cases, a driver receiving guidance 150 will have time to change lanes or adjust speed to avoid a collision or other "close call" due to the cut-in behavior by the other driver. In some embodiments, the guidance 150 includes a recommended or suggested maneuver (e.g., to slow down or change lanes to avoid a conflict/collision due to a predicted lane change by the driver of the ego vehicle).

In FIG. 1, lane-change prediction system 100 is symbolized as a cloud because, in some embodiments, lane-change prediction system 100 is implemented in one or more cloud servers that communicate with connected vehicles 110 and other network nodes (e.g., aerial drones 120 and infrastructure systems 130). The communication between a lane-change prediction system 100 hosted by one or more cloud servers and vehicles 110 is sometimes referred to as "vehicle-to-infrastructure" (V2I) communication.

Figure 2:
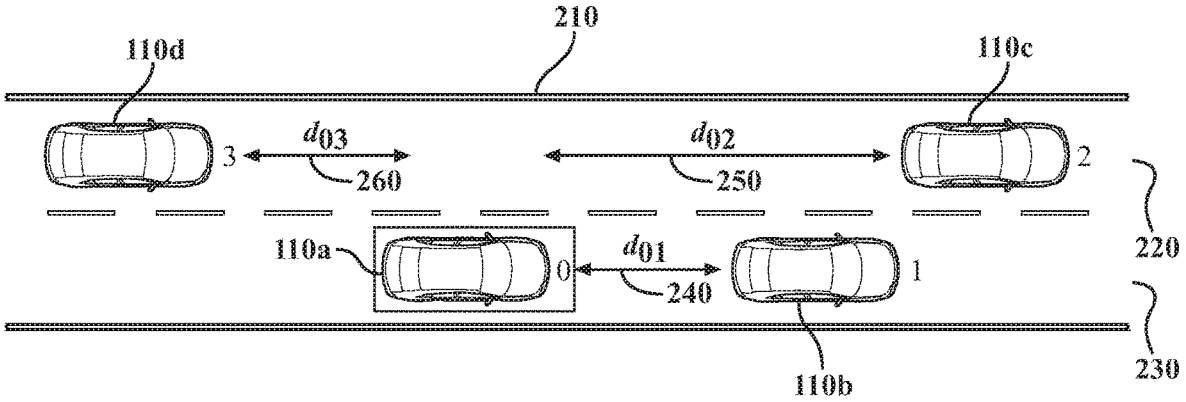
FIG. 2 is a diagram illustrating vehicles that interact with a lane-change prediction system, in accordance with an illustrative embodiment of the invention.

FIG. 2 is a diagram illustrating four vehicles 110 that interact with a lane-change prediction system 100, in accordance with an illustrative embodiment of the invention. FIG. 2 is a specific example of the kind of lane-change-behavior prediction discussed above in connection with FIG. 1. In FIG. 2, Vehicle 0 (110*a*), enclosed within a rectangle, is arbitrarily identified as the ego vehicle. Vehicle 1 (110*b*), Vehicle 2 (110*c*), and Vehicle 3 (110*d*) are other vehicles in the vicinity of the ego vehicle traveling along a roadway 210 that includes a left lane 220 and a right lane 230. Lane-change prediction system 100 receives, from the vehicles 110 themselves or other sources, vehicle information, as discussed above. In this example, lane-change prediction system 100 receives distance $d_{01}$ (240) (spacing between the ego vehicle and Vehicle 1 (110*b*)), distance d02 (250), distance $d_{02}$ (250) (spacing between the ego vehicle and Vehicle 2 (110*c*)), and distance d03 (260) (spacing between the ego vehicle and Vehicle 3 (110*d*)). This vehicle information is input to the personalized BNN for the driver of the ego vehicle (Vehicle 0 (110*a*)). The personalized BNN outputs predicted lane-change behavior for the driver of the ego vehicle (e.g., the probability that the driver will change lanes, the probability that the driver will remain in the current lane, or both). This prediction of lane-change behavior for the driver of the ego vehicle can be transmitted to Vehicle 3 (110*d*) as guidance 150, since that vehicle is following the ego vehicle.

FIG. 2 illustrates a simple example in which the roadway 210 includes only two lanes (220 and 230). In a three-lane topology, the lane-change-behavior prediction output by lane-change prediction system 100 can include an indication of the lane to which the driver of the ego vehicle is likely to change lanes, if there is more than one possibility. For example, if the ego vehicle is traveling in the center lane of a three-lane roadway, the prediction can indicate whether the ego vehicle is likely to change lanes toward the rightmost lane or the leftmost lane. In some embodiments, in such a situation, the output of the lane-change prediction model (the personalized BNN for the driver of the ego vehicle) can include the probability that the driver of the ego vehicle will change lanes toward the right, the probability that the driver of the ego vehicle will change lanes toward the left, and the probability that the driver of the ego vehicle will remain in the current lane.

The guidance 150 mentioned above can include actual probabilities of lane changing or lane keeping, or it can also include, in some embodiments, a recommended or suggested maneuver. For example, a head-up display (HUD) on the windshield might display near the ego vehicle, as seen through the windshield, "94% right lane change" to indicate that there is a 94% chance that the ego vehicle will change lanes toward the right. The foregoing concepts can be generalized to roadway topologies involving more than three lanes, as discussed further below.

Figure 3:
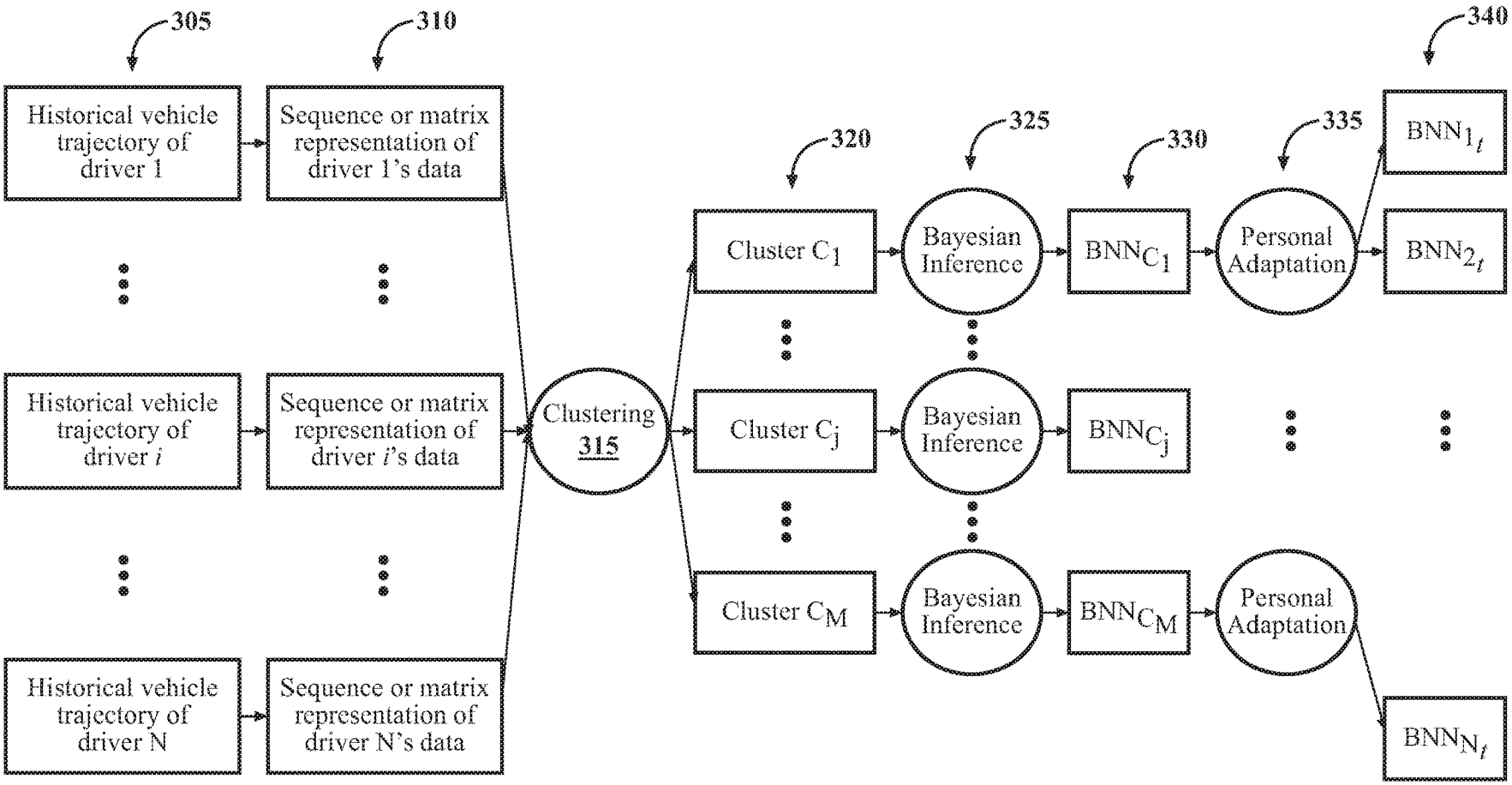
FIG. 3 is a block diagram of the processing operations to generate a personalized Bayesian neural network (BNN) for each of a plurality of drivers, in accordance with an illustrative embodiment of the invention.
Figure 4:
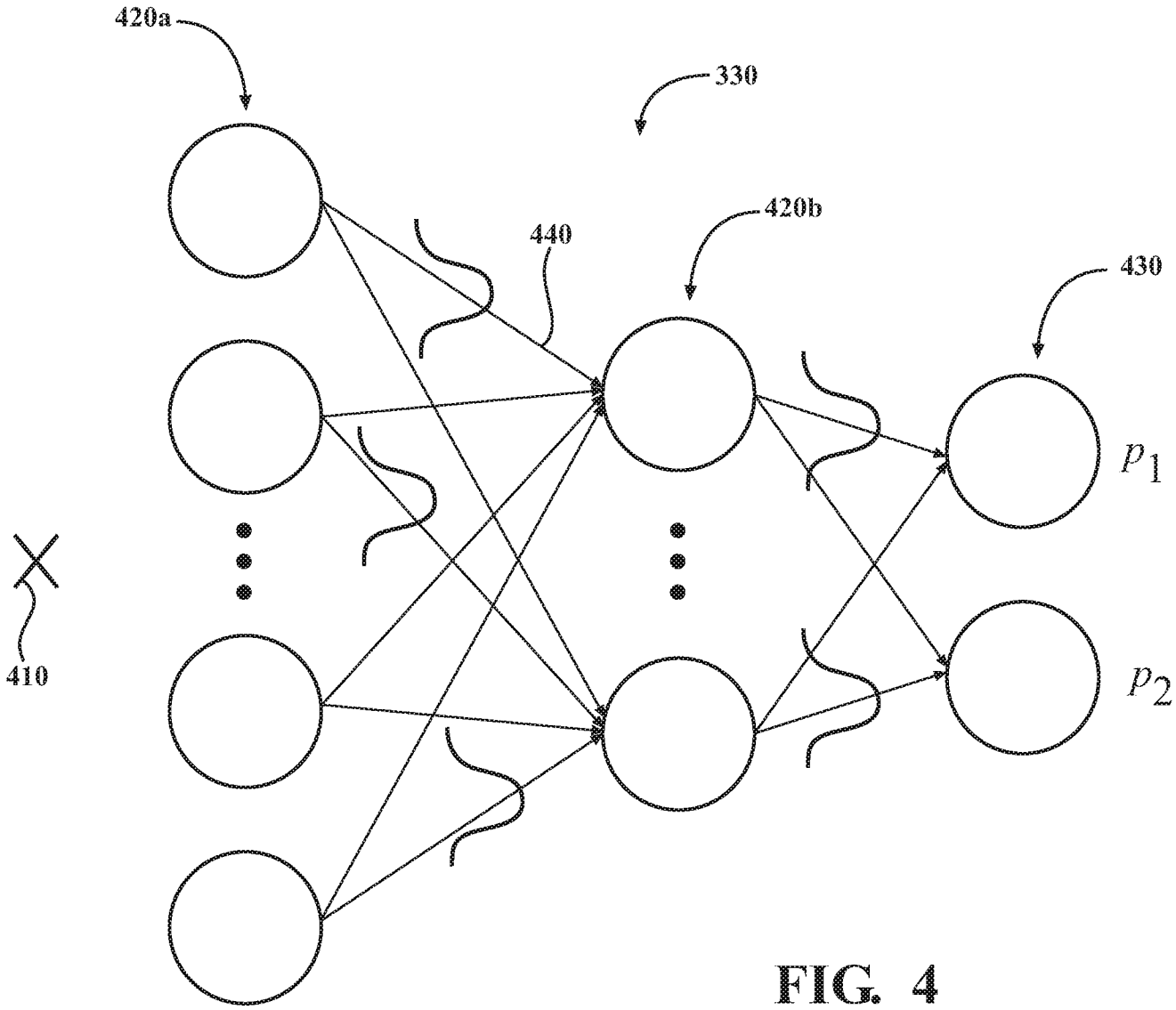
FIG. 4 is a diagram of a BNN, in accordance with an illustrative embodiment of the invention.

In connection with FIGS. 3 and 4, the focus of this description shifts to a discussion of how a personalized lane-change-behavior prediction model (e.g., a BNN) is generated for each of a plurality of drivers. This includes the process of training the BNNs.

FIG. 3 is a block diagram of the processing operations to generate a personalized Bayesian neural network (BNN) for each of a plurality of drivers, in accordance with an illustrative embodiment of the invention. The process begins with historical vehicle trajectory data 305 for each of the N drivers (FIG. 3 shows historical vehicle trajectory data 305 for drivers 1, i, and N). The historical vehicle trajectory data 305 of each driver is transformed to a corresponding alternative representation 310. In one embodiment, the historical vehicle trajectory data 305 is transformed to a sequence (vector) representation. In another embodiment, the historical vehicle trajectory data 305 is transformed to a matrix (two-dimensional) representation. In the case of a matrix representation, one dimension can be spatial and the other temporal, in some embodiments. In yet another embodiment, an encoder neural network can be used to compress or encode the historical vehicle trajectory data 305 before it is input to the clustering algorithm 315.

Clustering algorithm 315 is applied to the alternative representation 310 of each driver's historical vehicle trajectory data 305. Clustering is a widely used machine-learning technique to cluster objects (in this context, drivers) into several groups, where the objects in each group share similar characteristics. Herein, "clusters" and "groups" are used interchangeably. Clustering furthers the objective of generating a personalized lane-change-behavior prediction model for each driver. The reason is that the data of a single driver is generally not sufficient to train a machine-learning model. Clustering the drivers into groups of drivers exhibiting similar driving behavior permits the machine-learning model to be trained in a meaningful way. Thereafter, a personalized model for each individual driver can be generated by adapting the model for each cluster (group) in accordance with that individual driver's historical vehicle trajectory data 305, as discussed further below.

Underlying the clustering algorithm 315 is a technique for measuring the similarity between the driving behavior of any given pair of drivers in the plurality of N drivers. Examples of similarity measures or metrics include, without limitation, cosine similarity and pattern similarity. These similarity measures can be applied separately or in combination to a sequence-based alternative representation 310 of the historical vehicle trajectory data 305. In an embodiment in which the alternative representation 310 is a matrix representation, a convolution-based similarity measure can be used. Once the similarity between all possible pairs of drivers has been computed, a k-means or hierarchical clustering algorithm 315 can be used to produce M clusters 320, where M<N (the clusters 320 1, j, and M are shown in FIG. 3).

Once the data has been clustered into the M clusters 320, Bayesian inference (325) is applied to the clustered data to build a prediction model for each cluster 320. In some embodiments, a Bayesian neural network (BNN) 330 is trained as a prediction model for each cluster 320. An example of such a BNN is diagrammed in FIG. 4.

FIG. 4 is a diagram of a BNN 330, in accordance with an illustrative embodiment of the invention. The input X (410) includes one or more of the various types of vehicle information (spatial relationships among vehicles, vehicle position data, vehicle speed data, vehicle acceleration data, vehicle pose data, driver emotional-state data, driver fatigue-level data, etc.) discussed above. Unlike a conventional neural network where weights and biases are all point estimates (meaning that each weight or bias is a scalar value), weights and biases (440) in a BNN are all probability distributions, as indicated by the Gaussian "bell-curve" symbols in FIG. 4. As those skilled in the art are aware, obtaining an output from a neural network in which the weights and biases are all probability distributions involves sampling. For example, the distributions can, in some embodiments, be sampled 100 times.

In this example, BNN 330 also includes input layer 420*a*, hidden layer 420*b*, and output layer 430. The output layer 430 produces probability distributions $p_1$ and $p_2$, the probability distributions for lane keeping (remaining in the current lane) and lane changing, respectively. In some embodiments, the lane-keeping and lane-changing probabilities ($p_1$ and $p_2$) can be expressed as confidence intervals (e.g., "87% lane change, plus or minus 8%"). As those skilled in the art are aware, one of the advantages of a BNN over a conventional neural network is that it measures the uncertainty of its outputs. For example, the standard deviation of each output probability distribution $p_1$ and $p_2$ can be interpreted as a measure of uncertainty. This supports expressing the output in terms of a confidence interval, as explained above.

Referring once again to FIG. 3, as with conventional neural networks, an initial state is specified for weights and biases (440). In the case of a BNN 330, an initial distribution is assigned to each weight and bias (440). In one embodiment, a Gaussian prior $p(\theta)\sim N(0,1)$ is assigned for an arbitrary parameter θ. After observing some data D, it is possible to solve for the posterior distribution of θ as $$p(\theta \mid D) = \frac{p(D \mid \theta)p(\theta)}{p(D)}.$$

However, the denominator is sometimes intractable. Consequently, in some embodiments, Variational Inference is applied, and a distribution q(θ) to approximate the true posterior distribution p(θ|D) is computed. This approach permits a BNN 330 to be built for each cluster 320 and trained by using the historical vehicle trajectory data 305 of all drivers in that cluster 320.

Once a BNN 330 has been trained for each cluster 320, the BNN 330 of each cluster can be adapted (personal adaptation 335 in FIG. 3) to produce a personalized BNN 340 for each driver in that cluster 320. Once adaptation has been completed for all M clusters 320, the result is a personalized BNN 340 for each of the N drivers in the plurality of drivers. In FIG. 3, the personalized BNNs are identified as $BNN_{i'}$, where is an index representing one of the drivers in a cluster $c_j$. The approximated posterior distribution q(θ) for any parameter θ in $BNN_{c_i}$ can be treated as the prior distribution, and Variational Inference can be applied to derive a posterior distribution q'(θ) by the prior distribution q(θ) and the historical vehicle trajectory data 305 of driver i'. In this way, a cluster model $BNN_{c_j}$ can be adapted with an approximated posterior distribution q(θ) for any parameter θ to a personalized model $BNN_{i'}$ with an approximated posterior distribution q' (θ).

Once the N personalized BNNs 340 (one for each driver) have been generated, they can be stored in lane-change prediction system 100 for use in on-line (predictive) applications in which guidance 150 regarding the lane-change behavior of other drivers is provided to vehicles 110. In some embodiments, the BNNs 330 for the clusters 320 can continue to be updated (trained) as new data becomes available, and the personalized BNNs 340 for individual drivers can also continue to be updated (trained) based on new historical vehicle trajectory data 305. That is, in some embodiments, the BNN-based predictive models in lane-change prediction system 100 can continue learning and improving over time.

Figure 5:
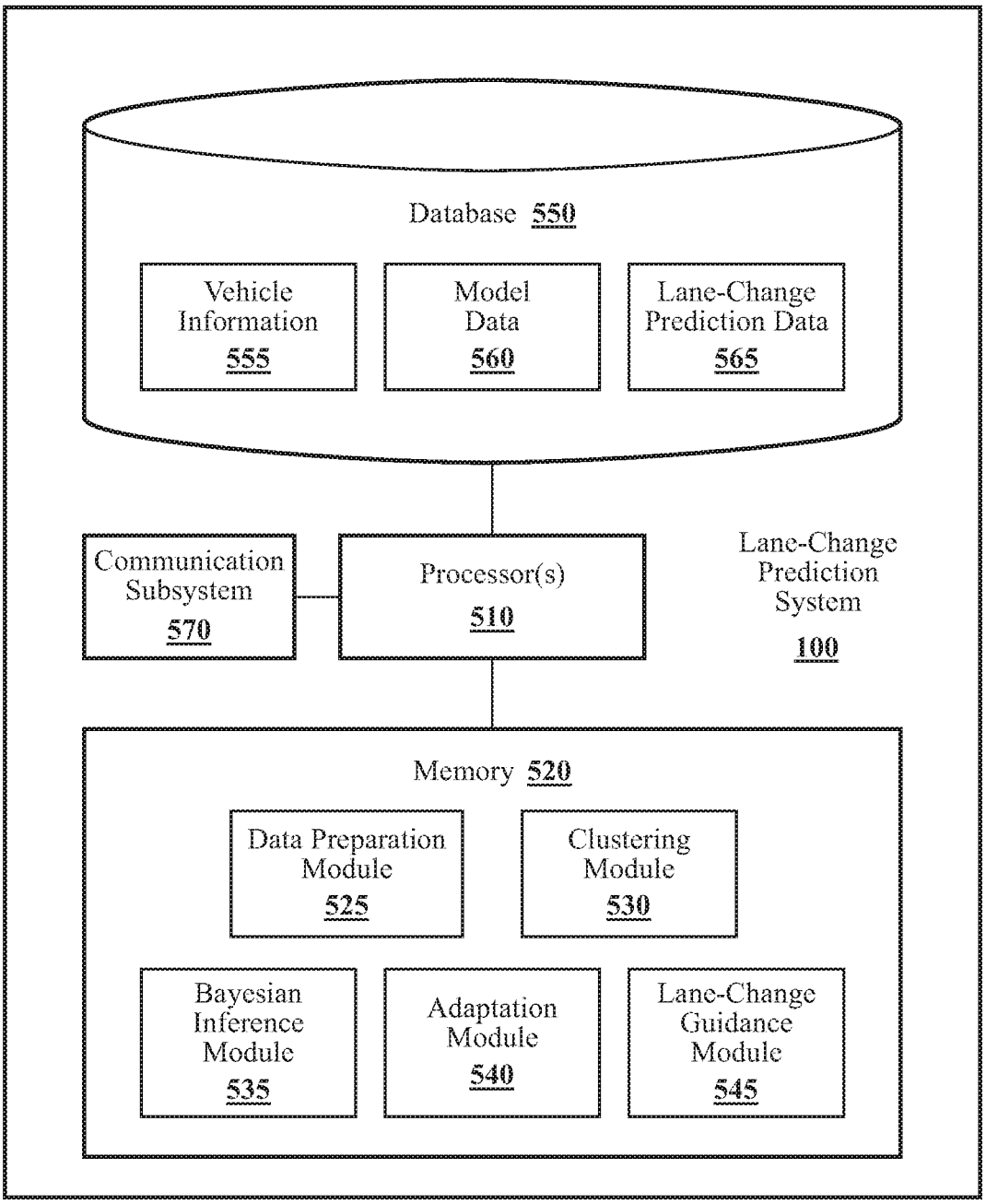
FIG. 5 is a functional block diagram of a lane-change prediction system, in accordance with an illustrative embodiment of the invention.

FIG. 5 is a functional block diagram of a lane-change prediction system 100, in accordance with an illustrative embodiment of the invention. In FIG. 5, lane-change prediction system 100 includes one or more processors 510 to which a memory 520 is communicably coupled. In one embodiment, memory 520 stores a data preparation module 525, a clustering module 530, a Bayesian inference module 535, an adaptation module 540, and a lane-change guidance module 545. The memory 520 is a random-access memory (RAM), read-only memory (ROM), a hard-disk drive, a flash memory, or other suitable non-transitory memory for storing the modules 525, 530, 535, 540, and 545. The modules 525, 530, 535, 540, and 545 are, for example, computer-readable instructions that, when executed by the one or more processors 510, cause the one or more processors 510 to perform the various functions disclosed herein.

As shown in FIG. 5, vehicle information 555 can be stored in a database 550. Model data 560 associated with the predictive models (BNNs) discussed above can also be stored in database 550. Such model data 560 can include, e.g., training data, model parameters, intermediate calculations, trained predictive models, etc. The lane-change prediction data 565 (the basis for the guidance 150 discussed above in connection with FIG. 1) can also be stored in database 550. Lane-change prediction data 565 includes probability distributions for the lane-change behavior of drivers output by their respective personalized BNNs 340.

To communicate with connected vehicles 110 and other network nodes (aerial drones 120, infrastructure systems 130, other servers on the Internet, etc.), lane-change prediction system 100 includes a communication subsystem 570 that supports wireless network protocols such as cellular data.

Data preparation module 525 generally includes instructions that when executed by the one or more processors 510 cause the one or more processors 510 to transform historical vehicle trajectory data 305 for each of a plurality of drivers into a corresponding alternative representation 310. In one embodiment, data preparation module 525 transforms the historical vehicle trajectory data 305 into a sequence (vector) representation. In another embodiment, data preparation module 525 transforms the historical vehicle trajectory data 305 into a matrix (two-dimensional) representation. As mentioned above, in the case of a matrix representation, one dimension can be spatial and the other temporal, in some embodiments. In yet another embodiment, an encoder neural network can be used to compress or encode the historical vehicle trajectory data 305 before it is input to the clustering algorithm 315.

Clustering module 530 generally includes instructions that when executed by the one or more processors 510 cause the one or more processors 510 to apply a clustering algorithm 315 to the corresponding alternative representations 310 of the historical vehicle trajectory data 305 to group the plurality of drivers into a plurality of groups (clusters 320). As explained above, the drivers in each group in the plurality of groups have similar driving behavior based on a predetermined similarity measure (e.g., cosine similarity, pattern similarity, or convolutional similarity, depending on the alternative representations 310 and the particular embodiment). Once the similarity between all possible pairs of drivers has been computed, clustering module 530 uses, for example, a k-means or hierarchical clustering algorithm 315 to produce a plurality of clusters 320 of drivers and their associated historical driving data.

Bayesian inference module 535 generally includes instructions that when executed by the one or more processors 510 cause the one or more processors 510 to apply, for each group (cluster 320) in the plurality of groups, Bayesian inference to the corresponding alternative representations 310 of the historical vehicle trajectory data 305 for the drivers in that group (320) to train a BNN 330 for the drivers in that group. Bayesian inference and the resulting trained BNNs 330 for the respective groups/clusters is discussed in greater detail above in connection with FIGS. 3 and 4.

Adaptation module 540 generally includes instructions that when executed by the one or more processors 510 cause the one or more processors 510 to adapt, for each group (320) in the plurality of groups, the BNN 330 for the drivers in that group to generate a personalized BNN 340 for each driver in that group. Adaptation (335) of the cluster BNNs 330 for individual drivers to generate the personalized BNNs 340 is discussed in greater detail above in connection with FIG. 3.

Lane-change guidance module 545 generally includes instructions that when executed by the one or more processors 510 cause the one or more processors 510 to provide, to one or more nearby vehicles 110, guidance 150 regarding the predicted lane-change behavior of a particular driver. This involves several aspects, each of which is discussed below.

One aspect of lane-change guidance module 545 is identifying a particular driver in the plurality of drivers while the particular driver is driving on a roadway. Depending on the particular embodiment, there are several ways in which the particular driver can be identified. In one embodiment, lane-change guidance module 545 identifies the vehicle 110 the particular driver is driving through wireless communication (e.g., V2I) with the vehicle 110. For example, the vehicle driven by the particular driver can report its vehicle identification number (VIN) or some other unique identifying information, such as a license plate number or a media access control address (MAC address), to lane-change prediction system 100. Once the vehicle 110 has been identified, lane-change guidance module 545 can identify the driver of the vehicle through a database lookup. In this embodiment, the driver of the vehicle is presumed to be the person listed in the database as the owner or primary operator of the vehicle 110.

In a different embodiment, the particular driver is identified through the particular driver, via the vehicle's onboard communication system, logging onto an on-line account of some kind (e.g., upon entering the vehicle 110). For example, the user, to access the services provided by lane-change prediction system 100, might, in some embodiments, be required to log into an on-line account. In this embodiment, the account credentials (e.g., user name and password) of the driver can be used to uniquely identify the particular driver entering the vehicle 110. In a variation of this embodiment, the driver can log onto an account (or remain signed in for some period) via a smartphone or other portable communication device, and that device can communicate with the vehicle's onboard computing system via, e.g., a Bluetooth connection to uniquely identify the driver. In yet another embodiment, the particular driver is identified through biometric data such as facial recognition (e.g., via a camera in the passenger compartment of the vehicle 110), a fingerprint scan, a retinal scan, a voiceprint, or other biometric identification technique.

Identification of the particular driver (discussed above in connection with FIG. 1 as the driver of the ego vehicle) permits lane-change guidance module 545 to access and input vehicle information 555 to the personalized BNN 340 for the particular driver.

Another aspect of lane-change guidance module 545 is receiving information regarding the vehicle 110 driven by the particular driver (the ego vehicle) and one or more other vehicles 110 in the vicinity of the ego vehicle. As discussed above, the received vehicle information 555 can include, without limitation, one or more of spatial relationships among the ego vehicle and the one or more other nearby vehicles 110, vehicle position data, vehicle speed data, vehicle acceleration data, vehicle pose data, driver emotional-state data, and driver fatigue-level data. Depending on the particular embodiment, lane-change guidance module 545 can receive vehicle information from a variety of different sources. For example, lane-change guidance module 545 can receive vehicle information from vehicles 110 (the ego vehicle and the other vehicles in the vicinity of the ego vehicle) themselves via the vehicles' sensor data 140. Lane-change guidance module 545, in some embodiments, can receive vehicle information from any of a variety of infrastructure systems 130 such as roadside units (RSUs), traffic signal systems, or other infrastructure systems or devices. Also, in some embodiments, lane-change guidance module 545 can receive vehicle information from one or more aerial drones 120.

Driver emotional-state data and driver fatigue-level data are available to lane-change guidance module 545 in embodiments in which the ego vehicle (the vehicle driven by the particular driver discussed above) includes an onboard system that monitors the biological state (e.g., heartrate, breathing, skin temperature) or other information about the driver (e.g., facial expressions identified using an interior camera, the driver's spoken statements, measured reaction time, observed level of attentiveness to the roadway, driving patterns, etc.). In such an embodiment, the ego vehicle 110 can report, to lane-change guidance module 545, information about the particular driver's emotional state and/or observed level of fatigue. That information can be used as an additional input to the Bayesian probabilistic lane-change prediction model (i.e., the personalized BNN 340 of the particular driver). In this embodiment, those additional inputs will also have been incorporated during the training phase described above in connection with FIG. 3.

Another aspect of lane-change guidance module 545 is estimating the probability that the particular driver will change lanes by processing the received vehicle information 555 using the personalized BNN 340 for the particular driver. In some embodiments, lane-change guidance module 545 also estimates the probability that the particular driver will remain in a current lane (lane keeping behavior) by processing the received vehicle information using the personalized BNN 340 for the particular driver. In such an embodiment, the guidance 150 regarding predicted lane-change behavior of the particular driver is based, at least in part, on the estimated probability that the particular driver will remain in the current lane. For example, the BNN shown in FIG. 4 outputs probability distributions $p_1$ and $p_2$, the probability distributions for lane keeping (remaining in the current lane) and lane changing, respectively. In other embodiments, the BNNs (330 or 340) can output more than two probability distributions. For example, in a roadway lane topology involving three or more lanes in the same direction where the particular driver is traveling in a lane with adjacent lanes on either side of the current lane, the personalized BNNs 340 can output probability distributions for a lane change to the left, a lane change to the right, and remaining in the current lane.

Another aspect of lane-change guidance module 545 is communicating guidance 150 regarding predicted lane-change behavior of the particular driver to at least one of the one or more other vehicles 110 in the vicinity of the ego vehicle based, at least in part, on the estimated probability that the particular driver will change lanes. In some embodiments, the vehicle or vehicles 110 receiving the guidance 150 from lane-change prediction system 100 are behind (following) the ego vehicle in the same or an adjacent lane. Those are the vehicles 110 that are most likely to benefit from the guidance 150. Not transmitting guidance 150 to vehicles that would not benefit from it (e.g., vehicles traveling in front of the ego vehicle) avoids bothering the drivers of those vehicles with needless, potentially annoying or distracting notifications.

The content of the guidance 150 can differ, depending on the embodiment. In some embodiments, the guidance 150 includes the estimated probability that the particular driver (the driver of the ego vehicle) will change lanes. In another embodiment, the guidance 150 includes the estimated probability that the particular driver will remain in the current lane. In some embodiments, the guidance 150 includes an indication of a particular lane to which the particular driver is likely to change lanes based on the probability distributions output by the personalized BNN 340 for the particular driver. For example, in a three-lane roadway topology where the ego vehicle is traveling in the center lane, the personalized BNN 340 can output the probability that the particular driver will remain in the current lane, the probability that the particular driver will change lanes to the left, and the probability that the particular driver will change lanes to the right. The guidance 150 transmitted wirelessly to one or more vehicles in the vicinity of the ego vehicle can be based on one or more of those three estimated probabilities.

In some embodiments, the guidance 150 includes a recommended driving maneuver to the driver of the vehicle receiving the guidance 150. For example, the guidance 150 may recommend or suggest slowing down somewhat and/or changing lanes to a particular lane to avoid a possible conflict/collision with the ego vehicle (the vehicle driven by the particular driver) based on an estimated high probability that the particular driver will soon exhibit "cut-in" behavior (i.e., suddenly cut in front of the vehicle driven by the driver receiving the guidance 150).

The manner in which guidance 150 is presented to the drivers of the vehicles receiving it can also differ, depending on the particular embodiment. In some embodiments, the guidance 150 is presented as text and/or graphics displayed somewhere within the vehicle interior where the driver can easily see it. For example, the text can be displayed on a HUD. In one embodiment, the HUD is the windshield itself. In this embodiment, augmented-reality (AR) techniques can be employed to effectively "annotate" the ego vehicle, as seen through the windshield, with text regarding the probability that the driver of the ego vehicle will change lanes or remain in the current lane. For example, text such as "89% lane change," "78% keep current lane," "92% right lane change," or "96% left lane change" can be displayed on the windshield-based HUD near the ego vehicle, as seen through the windshield. In an embodiment in which a recommended maneuver is included in guidance 150, the text annotating the ego vehicle on the HUD might read, for example, "89% lane change; recommend left lane change" or "96% right lane change; recommend slowing down."

In a different embodiment, the textual or graphical guidance 150 is presented to the driver of the receiving vehicle 110 on a different kind of display. For example, the guidance 150 may be presented on an in-dash LCD display. In this embodiment, a simple map or diagram can be used to help the driver of the receiving vehicle 110 identify which vehicle 110 in the environment is the ego vehicle to which the guidance 150 pertains. In yet another embodiment, the guidance 150 can be presented as one or more pre-recorded or computer-synthesized audio messages. In some embodiments, the guidance 150 is presented using both visual (text, graphics) and audible methods.

Figure 6:
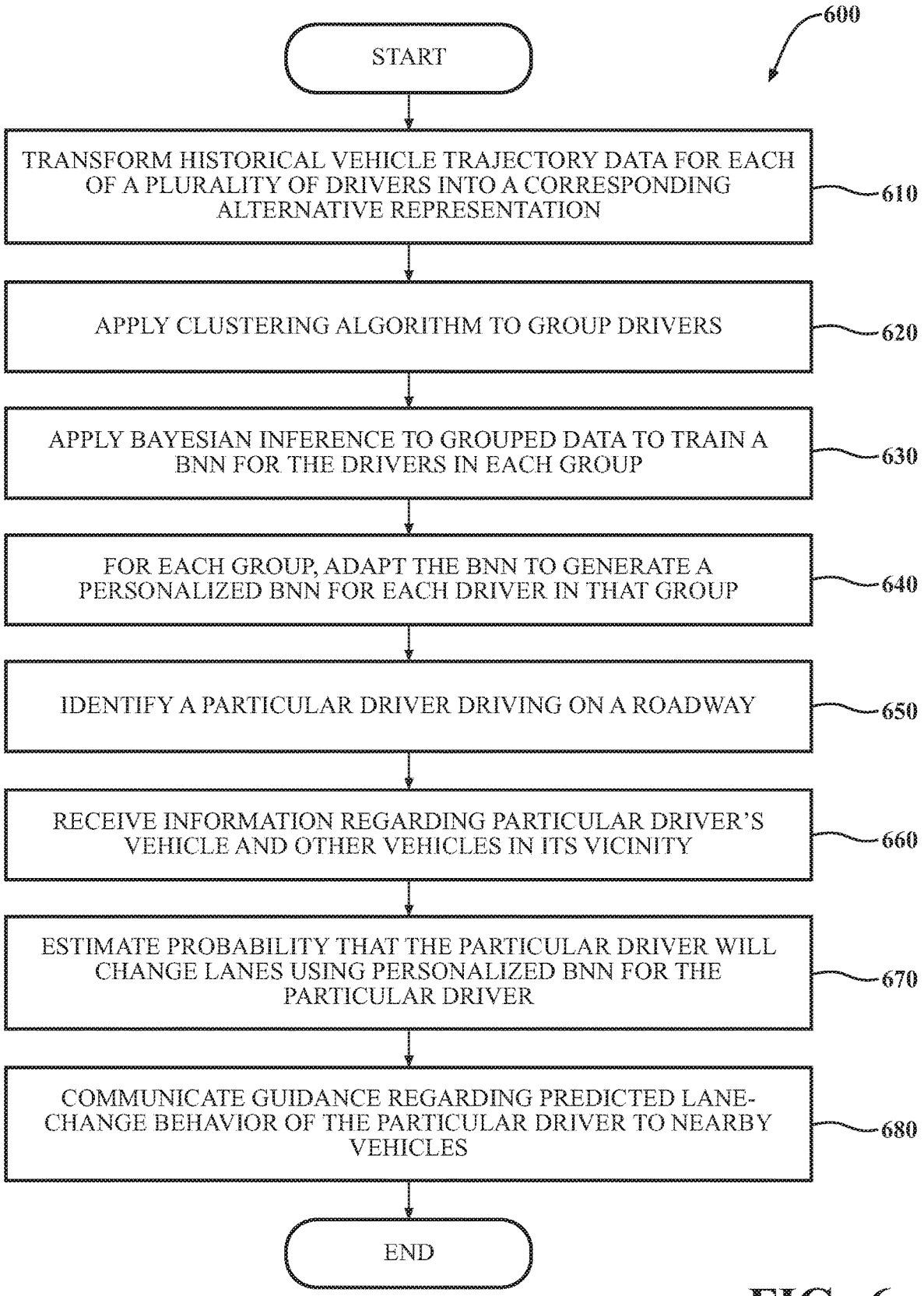
FIG. 6 is a flowchart of a method of providing guidance to vehicle drivers regarding predicted lane-change behavior of other vehicle drivers, in accordance with an illustrative embodiment of the invention.

FIG. 6 is a flowchart of a method 600 of providing guidance to vehicle drivers regarding predicted lane-change behavior of other vehicle drivers, in accordance with an illustrative embodiment of the invention. Method 600 will be discussed from the perspective of the lane-change prediction system 100 in FIG. 5 with reference to FIGS. 1-4. While method 600 is discussed in combination with lane-change prediction system 100, it should be appreciated that method 600 is not limited to being implemented within lane-change prediction system 100, but lane-change prediction system 100 is instead one example of a system that may implement method 600.

At block 610, data preparation module 525 transforms historical vehicle trajectory data 305 for each of a plurality of drivers into a corresponding alternative representation 310. As discussed above, in one embodiment, data preparation module 525 transforms the historical vehicle trajectory data 305 into a sequence (vector) representation. In another embodiment, data preparation module 525 transforms the historical vehicle trajectory data 305 into a matrix (two-dimensional) representation. As mentioned above, in the case of a matrix representation, one dimension can be spatial and the other temporal, in some embodiments. In yet another embodiment, an encoder neural network can be used to compress or encode the historical vehicle trajectory data 305 before it is input to the clustering algorithm 315.

At block 620, clustering module 530 applies a clustering algorithm 315 to the corresponding alternative representations 310 of the historical vehicle trajectory data 305 to group the plurality of drivers into a plurality of groups (see clusters 320 in FIG. 3), the drivers in each group in the plurality of groups having similar driving behavior. As discussed above, a predetermined similarity measure (e.g., cosine similarity, pattern similarity, or convolutional similarity, depending on the alternative representations 310 and the particular embodiment) can be used to measure the similarity in driving behavior between any given pair of drivers in a group. Once the similarity between all possible pairs of drivers has been computed, clustering module 530 uses, for example, a k-means or hierarchical clustering algorithm 315 to produce a plurality of clusters 320 of drivers and their associated historical driving data 305.

At block 630, Bayesian inference module 535 applies, for each group in the plurality of groups, Bayesian Inference (see block 325 in FIG. 3) to the corresponding alternative representations 310 of the historical vehicle trajectory data 305 for the drivers in that group to train a BNN 330 for the drivers in that group (cluster 320). Bayesian inference and the resulting trained BNNs 330 for the respective groups/clusters is discussed in greater detail above in connection with FIGS. 3 and 4.

At block 640, adaptation module 540 adapts, for each group in the plurality of groups, the BNN 330 for the drivers in that group to generate a personalized BNN 340 for each driver in that group (cluster 320). Adaptation (335) of the cluster BNNs 330 for individual drivers to generate the personalized BNNs 340 is discussed in greater detail above in connection with FIG. 3.

At block 650, lane-change guidance module 545 identifies a particular driver in the plurality of drivers while the particular driver is driving on a roadway. As discussed above, identifying the particular driver can be based on one or more of a unique identifier of the vehicle driven by the particular driver (e.g., VIN, license plate, or MAC address), account credentials associated with the particular driver, and biometric data associated with the particular driver.

At block 660, lane-change guidance module 545 receives information (see vehicle information 555 in FIG. 5) regarding a vehicle 110 driven by the particular driver (the ego vehicle) and one or more other vehicles 110 in the vicinity of the ego vehicle. As discussed above, the received vehicle information can include, without limitation, one or more of spatial relationships among the ego vehicle and the one or more other nearby vehicles, vehicle position data, vehicle speed data, vehicle acceleration data, vehicle pose data, driver emotional-state data, and driver fatigue-level data. Lane-change guidance module 545 can receive the vehicle information 555 from one or more of several different sources, including the vehicles 110 themselves, aerial drones 120, and/or infrastructure systems 130. For example, the received vehicle information 555 can be derived, at least in part, from vehicle sensor data 140, in some embodiments.

At block 670, lane-change guidance module 545 estimates the probability that the particular driver will change lanes by processing the received information (the vehicle information discussed above) using the personalized BNN 340 for the particular driver. As discussed above, in some embodiments, lane-change guidance module 545 also estimates the probability that the particular driver will remain in a current lane (lane keeping behavior) by processing the received vehicle information using the personalized BNN 340 for the particular driver. For example, the BNN 330 shown in FIG. 4 outputs probability distributions $p_1$ and $p_2$, the probability distributions for lane keeping (remaining in the current lane) and lane changing, respectively. In other embodiments, the personalized BNN 340 for the particular driver can output more than two probability distributions. For example, in a roadway lane topology involving three or more lanes in the same direction where the particular driver is traveling in a lane with adjacent lanes on either side of the current lane, the personalized BNN 340 can output probability distributions for a lane change to the left, a lane change to the right, and remaining in the current lane.

At block 680, lane-change guidance module 545 communicates guidance 150 regarding predicted lane-change behavior of the particular driver to at least one of the one or more other vehicles 110 in the vicinity of the ego vehicle based, at least in part, on the estimated probability that the particular driver will change lanes. As discussed above, in another embodiment, lane-change guidance module 545 includes instructions to estimate the probability that the particular driver will remain in the current lane by processing the received vehicle information using the personalized BNN 340 for the particular driver, and the guidance 150 regarding predicted lane-change behavior of the particular driver is based, at least in part, on the estimated probability that the particular driver will remain in the current lane. In those embodiments, the guidance 150 may include the estimated probability that the particular driver will remain in the current lane, as discussed above. How the content and manner of presenting the guidance 150 can vary from embodiment to embodiment is discussed above.

Figure 7:
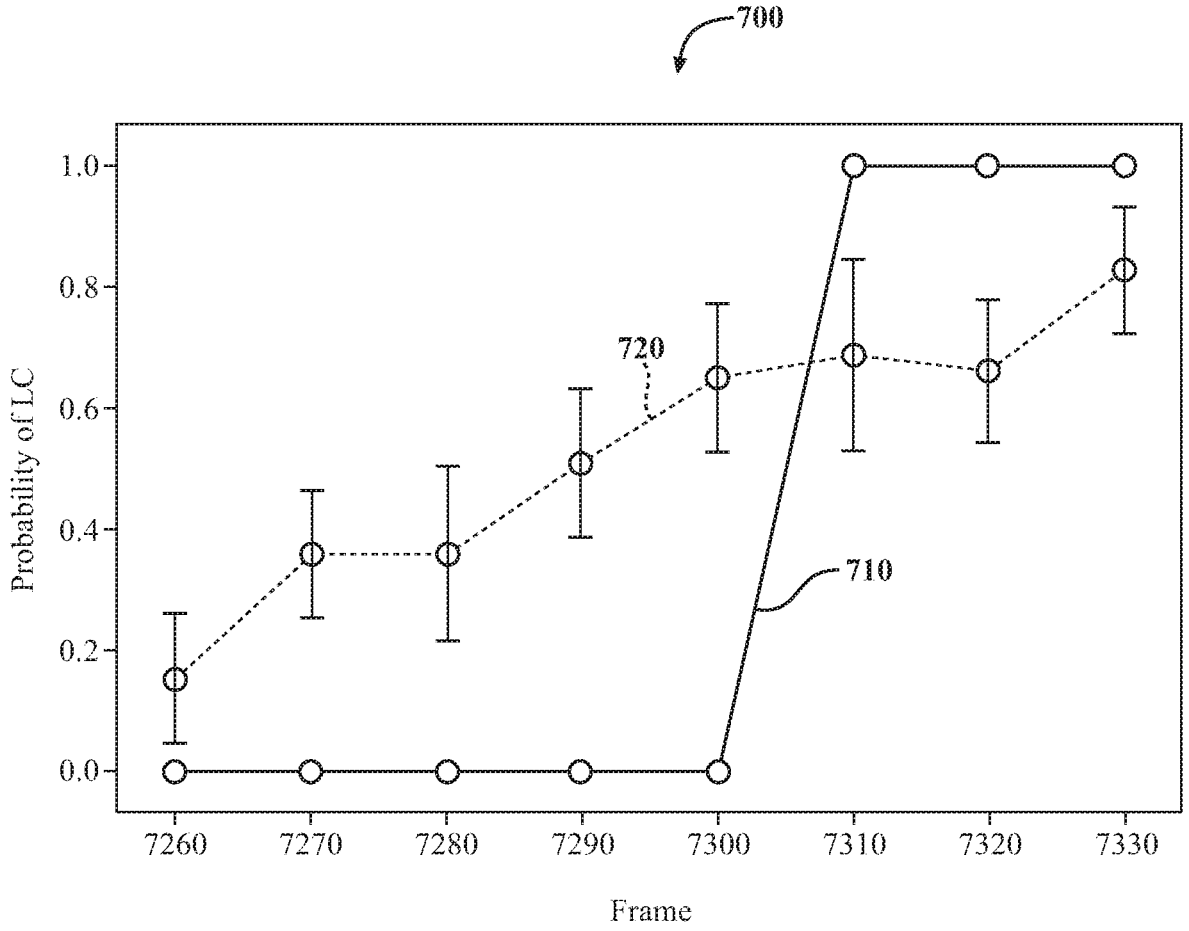
FIG. 7 is a graph comparing deterministic lane-change prediction with probabilistic lane-change prediction, in accordance with an illustrative embodiment of the invention.

FIG. 7 is a graph 700 comparing deterministic lane-change prediction with probabilistic lane-change prediction, in accordance with an illustrative embodiment of the invention. In the example of FIG. 7, a lane-change event occurs at Frame 7330. The deterministic approach (plotted as deterministic lane-change prediction curve 710) predicts the lane change two frames before it actually happens. The probabilistic approach in accordance with the embodiments described herein (plotted as probabilistic lane-change prediction curve 720 with the indicated standard deviations for the respective points), on the other hand, shows an overall increasing probability of the lane-change event well before it actually occurs. This permits lane-change prediction system 100 to draw the attention of a driver of a vehicle receiving guidance 150 at an earlier time. This gives the driver more time to decide, based on the lane-change or lane-keeping probability indicated in the guidance 150, whether to engage in some kind of protective or evasive maneuver (e.g., slowing down, changing lanes to avoid a conflict/collision with the ego vehicle).

The plurality of N drivers discussed above does not need to be limited or restricted to a particular geographic region. The plurality of N drivers can potentially be global (worldwide) in scope and can include a large number of drivers (e.g., millions or even billions). As connected-vehicle (e.g., V2I) technology becomes more readily available, the number of vehicles 110 and their drivers that can participate in a system like lane-change prediction system 100 will continue to increase.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-7, but the embodiments are not limited to the illustrated structure or application.

The components described above can be realized in hardware or a combination of hardware and software and can be realized in a centralized fashion in one processing system or in a distributed fashion where different elements are spread across several interconnected processing systems. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: a portable computer diskette, a hard disk drive (HDD), a solid-state drive (SSD), a read-only memory (ROM), an erasable programmable read-only memory (EPROM or Flash memory), a portable compact disc read-only memory (CD-ROM), a digital versatile disc (DVD), an optical storage device, a magnetic storage device, or any suitable combination of the foregoing. In the context of this document, a computer-readable storage medium may be any tangible medium that can contain or store a program for use by or in connection with an instruction execution system, apparatus, or device.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™ Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Generally, "module," as used herein, includes routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an application-specific integrated circuit (ASIC), a hardware component of a system on a chip (SoC), as a programmable logic array (PLA), or as another suitable hardware component that is embedded with a defined configuration set (e.g., instructions) for performing the disclosed functions.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g. AB, AC, BC or ABC).

As used herein, "cause" or "causing" means to make, command, instruct, and/or enable an event or action to occur or at least be in a state where such event or action may occur, either in a direct or indirect manner.

Aspects herein can be embodied in other forms without departing from the spirit or essential attributes thereof. Accordingly, reference should be made to the following claims rather than to the foregoing specification, as indicating the scope hereof.

What is claimed is:

1. A system for providing guidance to vehicle drivers regarding predicted lane-change behavior of other vehicle drivers, comprising:

one or more processors; and a memory communicably coupled to the one or more processors and storing:

a data preparation module including instructions that when executed by the one or more processors cause the one or more processors to transform historical vehicle trajectory data for each of a plurality of drivers into a corresponding alternative representation;

a clustering module including instructions that when executed by the one or more processors cause the one or more processors to apply a clustering algorithm to the corresponding alternative representations of the historical vehicle trajectory data to group the plurality of drivers into a plurality of groups, the drivers in each group in the plurality of groups having similar driving behavior;

a Bayesian inference module including instructions that when executed by the one or more processors cause the one or more processors to apply, for each group in the plurality of groups, Bayesian inference to the corresponding alternative representations of the historical vehicle trajectory data for the drivers in that group to train a Bayesian neural network (BNN) for the drivers in that group;

an adaptation module including instructions that when executed by the one or more processors cause the one or more processors to adapt, for each group in the plurality of groups, the BNN for the drivers in that group to generate a personalized BNN for each driver in that group; and a lane-change guidance module including instructions that when executed by the one or more processors cause the one or more processors to:

identify a particular driver in the plurality of drivers while the particular driver is driving on a roadway;

receive information regarding a vehicle driven by the particular driver and one or more other vehicles in a vicinity of the vehicle driven by the particular driver;

estimate a probability that the particular driver will change lanes by processing the received information using the personalized BNN for the particular driver; and communicate guidance regarding predicted lane-change behavior of the particular driver to at least one of the one or more other vehicles in the vicinity of the vehicle driven by the particular driver based, at least in part, on the estimated probability that the particular driver will change lanes.

2. The system of claim 1, wherein the corresponding alternative representation of the historical vehicle trajectory data for each of the plurality of drivers is one of a sequence representation and a matrix representation.

3. The system of claim 1, wherein the clustering algorithm includes at least one of k-means clustering and hierarchical clustering.

4. The system of claim 1, wherein the lane-change guidance module includes further instructions to estimate a probability that the particular driver will remain in a current lane by processing the received information using the personalized BNN for the particular driver and the guidance regarding predicted lane-change behavior of the particular driver is based, at least in part, on the estimated probability that the particular driver will remain in the current lane.

5. The system of claim 4, wherein the guidance regarding predicted lane-change behavior of the particular driver includes one or more of the estimated probability that the particular driver will change lanes, the estimated probability that the particular driver will remain in the current lane, an identification of a particular lane to which the particular driver is likely to change lanes, and a recommended maneuver to avoid a conflict with the vehicle driven by the particular driver.

6. The system of claim 1, wherein the information includes one or more of spatial relationships among the vehicle driven by the particular driver and the one or more other vehicles, vehicle position data, vehicle speed data, vehicle acceleration data, vehicle pose data, driver emotional-state data, and driver fatigue-level data.

7. The system of claim 1, wherein the information is received from one or more of vehicle sensors, infrastructure systems, and aerial drones.

8. The system of claim 1, wherein the lane-change guidance module includes instructions to identify the particular driver based on one or more of a unique identifier of the vehicle driven by the particular driver, account credentials associated with the particular driver, and biometric data associated with the particular driver.

9. A non-transitory computer-readable medium for providing guidance to vehicle drivers regarding predicted lane-change behavior of other vehicle drivers and storing instructions that when executed by one or more processors cause the one or more processors to:

transform historical vehicle trajectory data for each of a plurality of drivers into a corresponding alternative representation;

apply a clustering algorithm to the corresponding alternative representations of the historical vehicle trajectory data to group the plurality of drivers into a plurality of groups, the drivers in each group in the plurality of groups having similar driving behavior;

apply, for each group in the plurality of groups, Bayesian Inference to the corresponding alternative representations of the historical vehicle trajectory data for the drivers in that group to train a Bayesian neural network (BNN) for the drivers in that group;

adapt, for each group in the plurality of groups, the BNN for the drivers in that group to generate a personalized BNN for each driver in that group;

identify a particular driver in the plurality of drivers while the particular driver is driving on a roadway;

receive information regarding a vehicle driven by the particular driver and one or more other vehicles in a vicinity of the vehicle driven by the particular driver;

estimate a probability that the particular driver will change lanes by processing the received information using the personalized BNN for the particular driver; and communicate guidance regarding predicted lane-change behavior of the particular driver to at least one of the one or more other vehicles in the vicinity of the vehicle driven by the particular driver based, at least in part, on the estimated probability that the particular driver will change lanes.

10. The non-transitory computer-readable medium of claim 9, wherein the instructions further include instructions to estimate a probability that the particular driver will remain in a current lane by processing the received information using the personalized BNN for the particular driver and the guidance regarding predicted lane-change behavior of the particular driver is based, at least in part, on the estimated probability that the particular driver will remain in the current lane.

11. The non-transitory computer-readable medium of claim 10, wherein the guidance regarding predicted lane-change behavior of the particular driver includes one or more of the estimated probability that the particular driver will change lanes, the estimated probability that the particular driver will remain in the current lane, an identification of a particular lane to which the particular driver is likely to change lanes, and a recommended maneuver to avoid a conflict with the vehicle driven by the particular driver.

12. The non-transitory computer-readable medium of claim 9, wherein the information includes one or more of spatial relationships among the vehicle driven by the particular driver and the one or more other vehicles, vehicle position data, vehicle speed data, vehicle acceleration data, vehicle pose data, driver emotional-state data, and driver fatigue-level data.

13. A method of providing guidance to vehicle drivers regarding predicted lane-change behavior of other vehicle drivers, the method comprising:

transforming historical vehicle trajectory data for each of a plurality of drivers into a corresponding alternative representation;

applying a clustering algorithm to the corresponding alternative representations of the historical vehicle trajectory data to group the plurality of drivers into a plurality of groups, the drivers in each group in the plurality of groups having similar driving behavior;

applying, for each group in the plurality of groups, Bayesian inference to the corresponding alternative representations of the historical vehicle trajectory data for the drivers in that group to train a Bayesian neural network (BNN) for the drivers in that group;

adapting, for each group in the plurality of groups, the BNN for the drivers in that group to generate a personalized BNN for each driver in that group;

identifying a particular driver in the plurality of drivers while the particular driver is driving on a roadway;

receiving information regarding a vehicle driven by the particular driver and one or more other vehicles in a vicinity of the vehicle driven by the particular driver;

estimating a probability that the particular driver will change lanes by processing the received information using the personalized BNN for the particular driver; and communicating guidance regarding predicted lane-change behavior of the particular driver to at least one of the one or more other vehicles in the vicinity of the vehicle driven by the particular driver based, at least in part, on the estimated probability that the particular driver will change lanes.

14. The method of claim 13, wherein the corresponding alternative representation of the historical vehicle trajectory data for each of the plurality of drivers is one of a sequence representation and a matrix representation.

15. The method of claim 13, wherein the clustering algorithm includes at least one of k-means clustering and hierarchical clustering.

16. The method of claim 13, further comprising estimating a probability that the particular driver will remain in a current lane by processing the received information using the personalized BNN for the particular driver, wherein the guidance regarding predicted lane-change behavior of the particular driver is based, at least in part, on the estimated probability that the particular driver will remain in the current lane.

17. The method of claim 16, wherein the guidance regarding predicted lane-change behavior of the particular driver includes one or more of the estimated probability that the particular driver will change lanes, the estimated probability that the particular driver will remain in the current lane, an identification of a particular lane to which the particular driver is likely to change lanes, and a recommended maneuver to avoid a conflict with the vehicle driven by the particular driver.

18. The method of claim 13, wherein the information includes one or more of spatial relationships among the vehicle driven by the particular driver and the one or more other vehicles, vehicle position data, vehicle speed data, vehicle acceleration data, vehicle pose data, driver emotional-state data, and driver fatigue-level data.

19. The method of claim 13, wherein the information is received from one or more of vehicle sensors, infrastructure systems, and aerial drones.

20. The method of claim 13, wherein identifying a particular driver in the plurality of drivers while the particular driver is driving on a roadway is based on one or more of a unique identifier of the vehicle driven by the particular driver, account credentials associated with the particular driver, and biometric data associated with the particular driver.

* * * * *